US007077715B2

(12) United States Patent
Vassallo

(10) Patent No.: US 7,077,715 B2
(45) Date of Patent: Jul. 18, 2006

(54) SWIM FINS AND METHOD OF MANUFACTURE THEREOF

(75) Inventor: Shane Vassallo, Maroubra Beach (AU)

(73) Assignee: Pod Ware Pty Ltd., New South Wales (AU)

( * ) Notice: Subject to any disclaimer, the term of this patent is extended or adjusted under 35 U.S.C. 154(b) by 0 days.

(21) Appl. No.: 11/077,911

(22) Filed: Mar. 11, 2005

(65) Prior Publication Data

US 2005/0215137 A1 Sep. 29, 2005

Related U.S. Application Data

(63) Continuation of application No. PCT/AU03/01191, filed on Sep. 11, 2003.

(30) Foreign Application Priority Data

Sep. 12, 2002 (AU) ..... 2002951380
Sep. 11, 2003 (WO) ..... PCT/AU2004/024242

(51) Int. Cl.
*A63B 31/08* (2006.01)

(52) U.S. Cl. ..... 441/64

(58) Field of Classification Search ..... 441/64
See application file for complete search history.

(56) References Cited

U.S. PATENT DOCUMENTS

| | | | | |
|---|---|---|---|---|
| 5,163,859 | A * | 11/1992 | Beltrani et al. | 441/64 |
| 5,304,081 | A | 4/1994 | Takizawa | |
| 5,387,145 | A | 2/1995 | Wagner | |
| 6,152,794 | A | 11/2000 | Liu | |
| 6,224,443 | B1 | 5/2001 | Mehrmann et al. | |
| 6,568,974 | B1 * | 5/2003 | Semeia | 441/64 |

FOREIGN PATENT DOCUMENTS

| | | | |
|---|---|---|---|
| EP | 0 436 927 | A1 | 7/1991 |
| EP | 0 579 046 | A1 | 1/1994 |
| EP | 0 640 361 | A1 | 3/1995 |
| EP | 0 884 073 | A2 | 12/1998 |
| EP | 1 192 974 | A2 | 4/2002 |

* cited by examiner

*Primary Examiner*—Stephen Avila
(74) *Attorney, Agent, or Firm*—Pearne & Gordon LLP

(57) ABSTRACT

A swim fin formed from laminated rubberized layers. The fin has a fin body with a foot pocket, which includes an opening to receive the foot of a wearer. A fin body includes a distal trailing region integral with the foot pocket capable of flexure upwardly, downwardly and rearwardly of the body, by action of water when the fin is in use. Structure engages a heel of a user to maintain a users foot in the foot pocket. The fin includes at least one outer rubberized layer and at least one inner rubberized layer, the at least one inner layer forming the foot pocket. The fin is produced in a compression mold having first and second mold parts and a foot mold for forming the pocket.

35 Claims, 6 Drawing Sheets

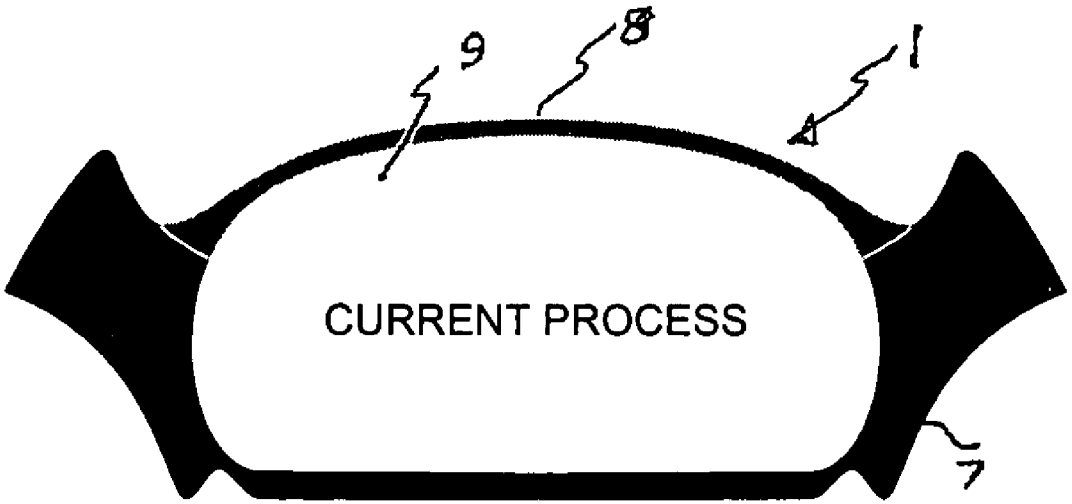
FIGURE 2
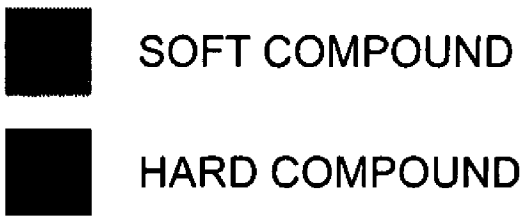

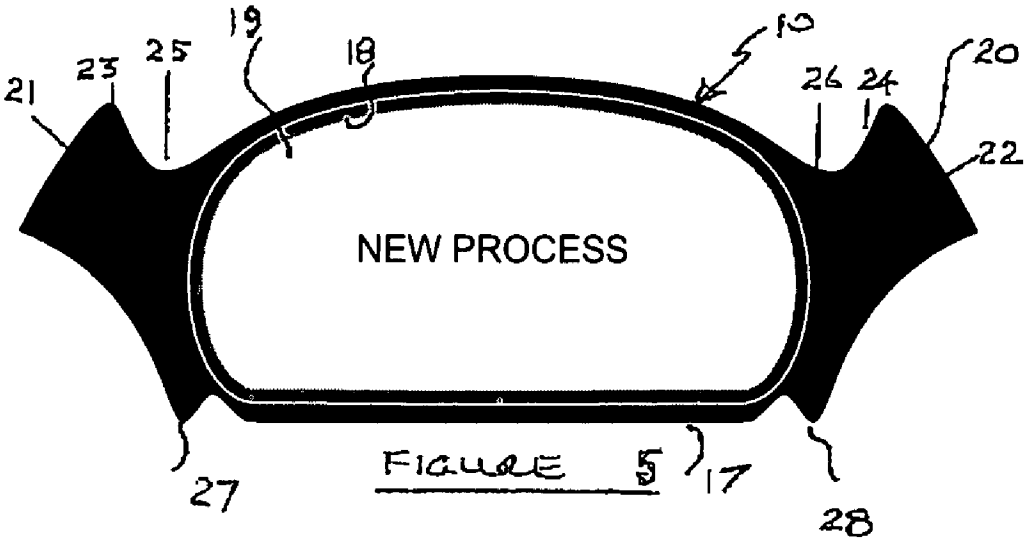
Figure 5
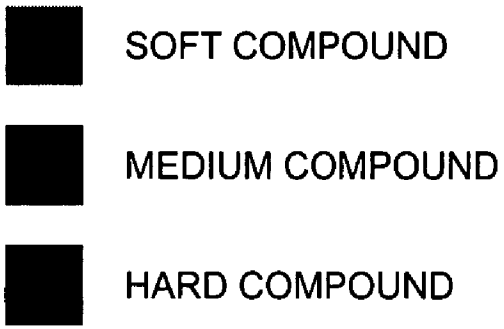

SWIM FINS AND METHOD OF MANUFACTURE THEREOF

This application is a Continuation under 35 USC 111 of PCT/AU2003/01191 (WO 2004/024242) filed on Sep. 11, 2003 claiming priority of Australian Application No. 2002 951380 filed Sep. 12, 2002.

BACKGROUND

The present invention relates to improvements in swim fins and flippers and more particularly relates to a swim fin and method of manufacture thereof which includes fin geometry resulting in a more mechanically efficient, economic, flexible, soft, light weight and comfortable fin in comparison to the known fins. The improvements in such fins enable enhanced maneuverability for the swimmer to whose foot or feet the swim fin or fins are attached. The present invention also provides an improved method of fin construction in which layer hardness distribution throughout the fin is more efficient in that there is increased user comfort, improved geometry and more efficient aqua dynamics.

PRIOR ART

Swimmers such as surfers and body board users commonly attach swim fins to their feet to gain greater maneuverability. This is achieved by kicking which causes the fins to flex and push against the water with greater force than is possible using the feet alone.

There are in existence a wide variety of fin designs each having a particular aqua dynamic effect dictated by their flexibility, weight, shape and configuration. Fin flexibility is a function of, the particular construction of the fin and the stiffness of the material used.

The shape and contour of a swim fin is largely dictated by its function. Thus, long fins are used in such activities as scuba diving and short fins are used in such activities as surfing where less purchase in the water (or water displacement) is required. The longer the fin, the greater the load on the foot of the wearer but greater the water displacement. The shorter the fin the lower the load on the foot of the wearer and lower the displacement. In fin design the objective is to provide a comfortable fin which reduces wearer effort without compromise to efficiency. Efficiency is related to wearer effort versus mechanical advantage. An efficient fin propels the wearer with maximum thrust but with a minimum of effort. The differences between fin designs can be subtle but a subtle change in design can result in a more or less efficient fin.

Another design criterion is foot comfort. This is predominately a function of material softness disposed in the right places so the foot interacts favorably with the rubber of the fin. Ideally, soft compound rubber will be located in areas of the fin which engage the foot and hard compound rubber will be in those areas which require sufficient stiffness to resist excessive flexure during water displacement. Thus, fin design is a compromise between adequate stiffness for propulsion and sufficient softness for wearer comfort.

As an example, a known fin is disclosed in U.S. Pat. No. 6,354,894 which teaches a, spear bladed swim fin which enables divers to propel themselves through the water. Spear-bladed swim fins generally provide a lower surface area to a higher perimeter edge length. By reducing the effective surface area of the swim fin, more propulsive force is delivered by the fin for each kick of the diver. Such dispersion of the diver's energy may be particularly advantageous where stationery swimming is required. Additionally, vortices generated during swim kicks may advantageously complement the operation of the swim fin. The spear blade has a large channel through which water can flow to eliminate dead spots on the lee side of the fin. Fork extension stubs present with the foot pocket of the swim fin provide an adjustable means by which the flexing, bowing, and/or geometry of the swim fin blade may be adjusted according to the preferences and/or demands of the diver.

Another known fin is disclosed in U.S. Pat. No. 5,533,918 which teaches a swim fin unit for use on the foot of a swimmer, comprising a body defining a foot receptacle that opens endwise forwardly; a first fin structure integral with and extending generally rearwardly of the body to be flexed upwardly and downwardly rearwardly of the body by water pressure; and a second fin structure integral with and extending generally vertically rearwardly relative to the body; wherein the said first fin structure defines a first plane and the second fin structure defines a second plane; the first and second planes intersecting in generally perpendicular relation.

With the advancement of scuba diving and snorkeling, swim fins have likewise developed in order to propel the swimmer through the water more efficiently. As with the swimming fins of fish, swim fins for human beings have certain dynamic characteristics, depending upon fin architecture, that provide for different types of propulsion through the water.

Most swim fins, particularly those often used in conjunction with body surfing and body board surfing, scuba and skin diving, are bladed fins having edges extending outwardly from a foot pocket. Webbing is present in the form of elastic or plastic webbing that forms a blade by which the diver propels him or herself. Such swim fins often resemble the rounded or truncate caudal fins present on fish. Consequently, such swim fins provide strength, but generally not speed. As a result, skin and scuba divers swimming around reefs and trying to cover longer distances in calm waters must generally work harder in order to propel themselves faster. Additionally, such bladed swim fins are not adjustable and the lateral edges and the blade webbing does generally not provide any adjustment with respect to the foot pocket.

In addition to the shape and configuration, the materials and methods of construction determine whether the fin will be efficient in use and comfortable for the wearer. Fins are typically manufactured from layers of different compound rubbers. A soft compound is normally used for the foot housing to facilitate convenient and comfortable insertion of the foot therein and also to prevent abrasion from hard edges. A hard compound is used for the free trailing end blade as this requires a minimum stiffness to displace water without unwanted excessive flexure or bending. The known fins and particularly surfing fins have undergone many changes in geometry over the years each attempting to achieve maximum efficiency (propulsion) for minimum user effort. There is always room for improvement in fin design and method of construction to achieve more improvements in geometry, comfort and user efficiency.

INVENTION

The present invention provides an improved fin which results in a more economic, flexible, soft, light weight and comfortable fin.

It is an object of the invention to provide a method of construction of a fin and a fin produced by that method of construction.

It is an object of the invention to provide an improved fin which meets the needs for significantly enhanced maneuverability realized when used by a surfer, swimmer or surf or body board user. It is another object of the invention to provide a more comfortable fin having improved flexibility and without compromise to the economics of manufacture or to aqua dynamic efficiency.

According to a method aspect the present invention provides an improved method of construction of a fin in which layers of rubber are preset prior to compression molding. According to a preferred embodiment, prescribed rubber layers which will form a bottom of a fin are set along with layers for a heel strap region. A foot mold is introduced between those layers and upper layers which will form an upper surface of the fin including the foot pouch.

In one broad form the present invention comprises a laminated swim fin formed using two or more rubberized layers each having different hardness; the fin comprising;

a) a foot body defining a foot receptacle, that includes an opening to receive the foot of a wearer;

b) a first region integral with and extending generally rearwardly of the body to be flexed upwardly and downwardly and rearwardly of the body, by action of water when the fin is in use;

c) the fin including an outer layer of medium hardness rubberized material;

d) an inner layer of soft compound rubber forming the foot receptacle;

e) a layer of hard rubberized material; wherein, the layer of hard material is disposed laterally of the foot receptacle.

In another broad form the present invention comprises:

a swim fin for use on the foot of a swimmer, the fin comprising;

a foot body defining a foot receptacle, that includes an opening to receive a foot of a wearer;

a fin body integral with and extending from the body of the foot receptacle and which is capable of being flexed upwardly and downwardly during use and responsive to water pressure wherein, the foot receptacle comprises a soft compound rubber and the fin body includes a medium compound rubber;

the fin body further comprising lateral hard rubber regions between the medium and soft compounds wherein the hard rubber regions and medium rubber layer combine to form contoured splay rails which contribute to water displacement and propulsion of the user.

According to the preferred embodiment the splay rails are symmetrical about a longitudinal axis through the fin.

In its broadest for the present invention comprises;

a swim fin including a leading end and a trailing end, the leading end including a recess for receiving a foot of a wearer and the trailing end being a free end which displaces water each sweeps through the water;

the fin including a laminated construction comprising a first layer of medium hardness rubberized material ; a second layer of hard rubberized material and a third layer of soft rubberized material; wherein the first and second layers envelope said third layer of soft material.

In a broadest form of a method aspect the present invention comprises; a method of construction of a swim fin, the method comprising the steps of;

a) providing a first layer of medium compound rubberized material;

b) placing a pocket mold in apposition to the first layer to allow formation of a foot pocket in the fin;

c) applying a layer soft compound rubber about said foot pocket;

d) applying a hard compound rubber between said medium compound rubber and said soft compound rubber;

e) forming an envelope with said medium compound rubber to retain said foot pocket and said hard compound rubber;

f) bonding said soft, medium and hard layers by heat fusion.

According to one embodiment of the method aspect, the bonding of layers may be by a combination of heat fusion and compression.

In another broad form of a method aspect the present invention comprises: a method of construction of a swim fin using a compression mold, the method comprising the steps of;

a) providing at least one layer of rubberized material having a first degree of hardness;

b) providing at least one layer of rubberized material having a second degree of hardness and being a harder material that the first degree of hardness layer;

c) taking a mold capable of forming a foot cavity in said fin and placing the mold over at least the said at least one layer of rubberized material having a first degree of hardness;

d) laying over the foot mold two rubberized layers of either the same or different hardness, e) compression molding all said layers about said foot mold such that at least layers adjacent said mold conform to the shape of said mold and form a foot pocket;

f) separating mold parts of said compression mold;

g) removing said foot mold from a foot pocket in a so formed fin.

The method may comprise the further preliminary step of milling the rubber layers to a predetermined thickness. A preferred (but non limiting) layer thickness would be in the region of 10–15 mm. The layers can be milled to as low as 3 mm thick by running the layers through a rolling machine. Also, each layer may be of varying thicknesses The fin formed by the process according to the invention has a stiff inner hard layer, a medium outer layer of reduced stiffness and a foot pocket of soft rubber.

According to a preferred embodiment the fin comprises a first medium layer of a first color, a second layer of a soft rubber layer having a second color and a hard layer of a third color. Preferably the colors of said layers provide an indication of the hardness or stiffness of the layers which comprise the fins.

The method comprises the further step, before laying out said layer of medium compound rubber, of guillotining the layer to a shape according to the geometry of the fin required.

DETAILED DESCRIPTION

The present invention will now be described according to a preferred but non limiting embodiment and with reference to the accompanying illustrations, wherein FIG. 1 shows a plan view of a typical known fin constructed in accordance with prior art methodology;

FIG. 2 shows a cross sectional view of a fin constructed in accordance with the prior art.

FIG. 5 shows a cross section across a line A—A as shown in FIG. 3 according to one embodiment.

Figure 1:
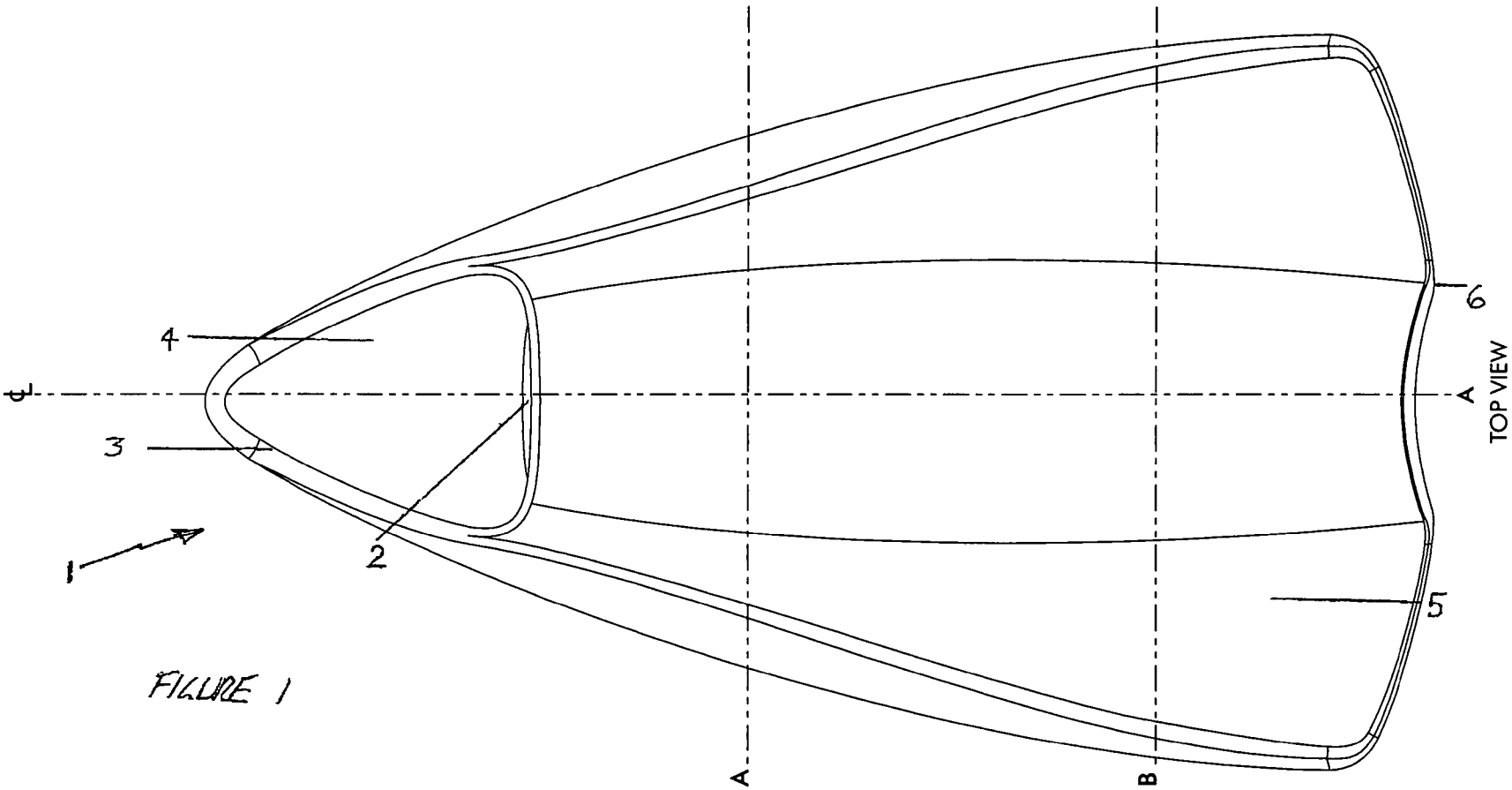

Referring to FIG. 1 there is shown a plan view of a typical known fin 1 constructed in accordance with prior art methodology. Typically a fin of the type of FIG. 1 is divided into key regions which relate to functionality of the fin. Accordingly, fin 1 comprises a foot pocket 2 disposed in a central region of the fin. Fin 1 also includes a retaining strap 3 which defines an opening 4 through which a users foot is inserted. Retaining strap 3 engages a users heel to retain the foot in foot pocket 2. Fin 1 further comprises a distal or trailing end 5 which forms the major area of the overall fin. Trailing or distal end 5 is splayed outwards such that it is widest at edge 6. The broad width at trailing end 5 enable the fin to displace a substantial amount of water when used by a swimmer.

FIG. 2 shows a cross sectional view of fin 1 of FIG. 1 taken across a line A—A constructed in accordance with the prior art. As may be seen from FIG. 2, fin 1 comprises a first hard rubber compound layer 7 which is heat fused with a second softer rubberized material 8 which forms a molded foot pocket 9 which receives and retains a foot of a wearer. This prior art fin is manufactured by fusing the hard layer 7 with the soft layer 8. The result is a generally hard fin base and a soft upper wall 8 of foot pocket 9 which is flexible enough to enable a wearer to insert the foot and provide foot comfort during use. Typically the known fins include a leading (proximal) end and a trailing end. Intermediate the leading (proximal) end terminating in strap 3 is a foot pocket 2 for receiving and retaining a foot of a wearer; wherein the trailing end has a relatively stiff free end which displaces water each sweep of fin 1 through water.

Figures 3, 4:
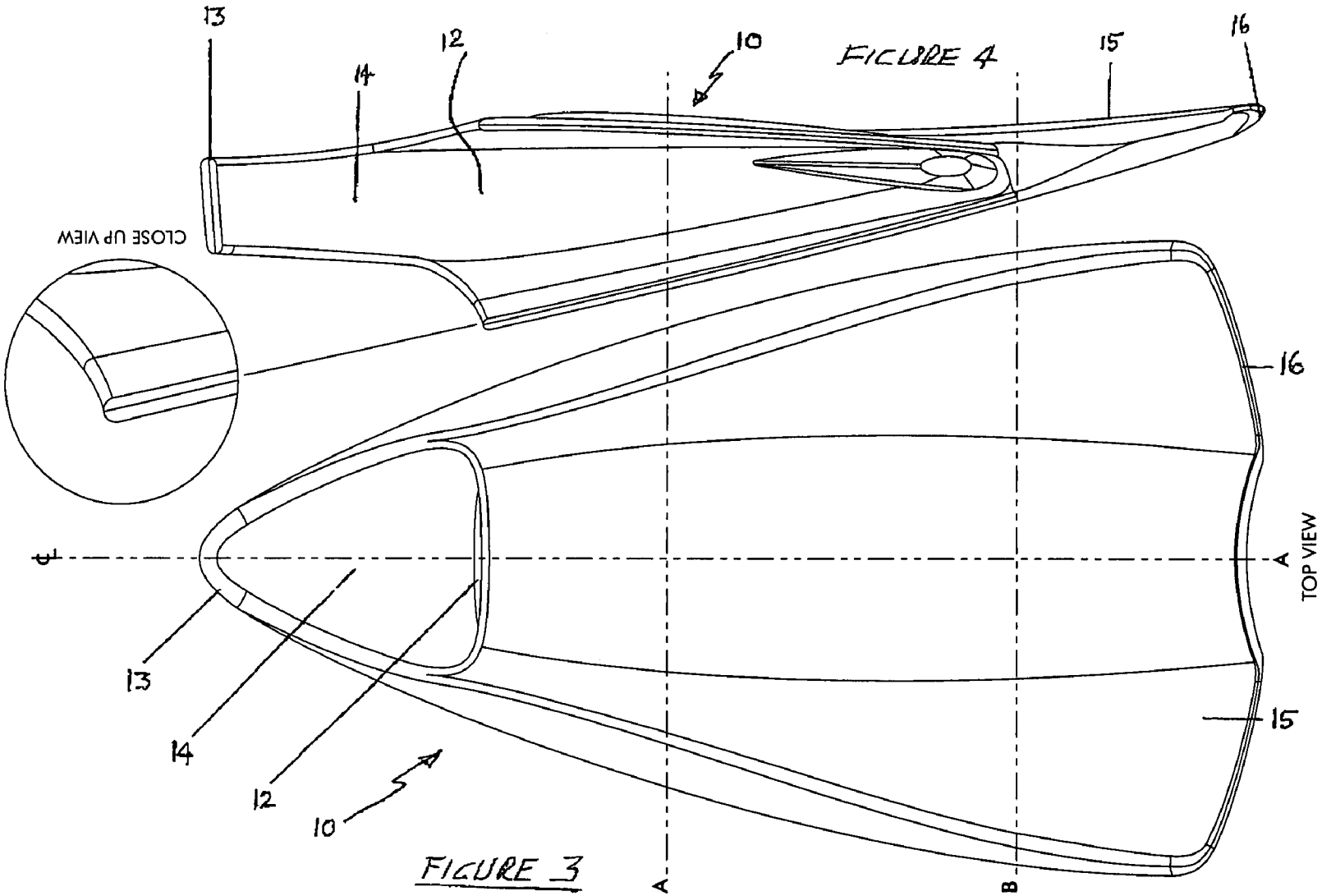
FIG. 3 shows a plan view of a fin constructed in accordance with a preferred embodiment of the invention.
FIG. 4 shows s side elevation view of the fin of FIG. 3 .

FIG. 3 shows a plan view of a fin 10 constructed in accordance with a preferred embodiment of the invention. Typically a fin of the type of FIG. 3, as with fin 1 described with reference to FIG. 1 is divided into three key regions which relate to functionality of the fin. Accordingly, fin 10 comprises a foot pocket 12 disposed in a central region of the fin. Fin 10 also includes a retaining strap 13 which defines an opening 14 through which a users foot is inserted. Retaining strap 13 engages a users heel to retain the foot in foot pocket 12. Fin 10 further comprises a distal or trailing end region 15 which forms the major area of the overall fin. Trailing or distal end 15 is splayed outwards such that it is widest across edge 16. The broad width at trailing end 15 enables the fin to displace a substantial amount of water when used by a swimmer.

FIG. 4 shows a side elevation of the fin of FIG. 3 with corresponding numbering.

FIG. 5 shows a cross section taken along a line A—A through fin 10 according to one embodiment and manufactured in accordance with the method aspect of the invention. As shown in FIG. 5, fin 10 comprises a first medium hardness layer 17 of rubberized material which is heat fused with a second inner layer 18 of softer rubberized material which forms a molded foot pocket 19 which receives and retains a foot of a wearer. Fin 10 further comprises a hard compound rubber 20 which is retained between layers 17 and 18. The result is a generally medium hardness outer layer, a soft inner layer 18 for foot comfort and lateral hard regions which reinforce generally stiff but flexible splay rails 19 and 21.

According to one embodiment, the invention provides a swim fin including a leading end and a trailing end, the leading end including recess for receiving a foot of a wearer and the trailing end being a free end which displaces water each sweep through the water. Fin 10 is a laminated construction in which soft layer 18 is in apposition with and enveloped by outer layer 17 and hard layer 20. The method of construction of fin 10 according to one embodiment, generally comprises the following steps.

A first layer 17 of medium compound rubberized material is provided which is laid out on a platform after it is cut to the required configuration. Next a pocket mold (not shown) is placed in apposition to first layer 17 to allow formation thereabout of a foot pocket in the fin formed by soft layer 18. Soft compound rubber layer 18 is disposed about the foot mold (not shown) to form the foot pocket 19. Hard compound rubber layer 20 is disposed between soft compound rubber 18 and medium compound rubber layer 17 so that the hard compound rubber layer 20 has a boundary with the soft inner layer 12 and outer medium rubber compound layer 17. The medium layer 17 may be wrapped over the inner soft layer 18 and hard layer 20. Each of layers 17, 18 and 20 are preferably bonded by heat fusion and compression molding techniques. In a preferred embodiment, the fin 10 includes splay rails 21 and 22 formed on each side, the rails comprising respectively upper edges 23 and 24 and respective recesses 25 and 26.

The layers of the fin will typically be specified according to a flow index of the rubberized material layers. The method comprises the further step, before laying out said layer of medium compound rubber, of guillotining the layers so they are cut to size before compression molding. A process for construction of the fin will be described below with reference to FIG. 8.

The fin 10 formed by the process according to the embodiment described with reference to FIG. 5 above has a stiff hard layer, a medium outer layer of reduced stiffness and an inner foot pocket of soft rubber.

According to a preferred embodiment the fin comprises a first medium layer of a first color, a second layer of a soft rubber layer having a second color and a hard layer of a third color. Preferably the colors of said layers provide an indication of the hardness or stiffness of the layers which comprise the fins. The fin may be constructed of laminated layers of the same color but it has been found convenient to employ layers of different colors to represent layers of different hardness and also to enhance the visual effect of the finish as layers of different colors undergo migration during compression molding.

The foot recess 19 migrates from a wide region tapering to a narrower region at its opposite end wherein the splay rails 23 and 24 are disposed so as to increase the efficiency of travel of the fin through water and the mechanical advantage to the user. The upper edge of the fin is that which is nearest the users ankle and the lower edge is that which is nearest the soles of the users feet. The upper edge extends laterally beyond the lower edge so that contoured recesses 25 and 26 on opposite sides is formed when viewed in cross section. Fin 10 further comprises and inner rails 27 and 28. The rails 21 and 22 and corresponding recesses 25 and 26 contribute to thrust provided by the fin and increase mechanical advantage.

The upper edge rails 21 and 22 are to some extent flexible as a medium compound rubber is used to form the edges. The lower/inner edge rails 27 and 28 may flex to some extent laterally as the upper edge flexes substantially vertically. The cup like recess 25 and 26 formed by the upper and lower edges cause side thrust in conjunction with lateral displacement of water as the fin is maneuvered in an up and down sweep through the water. Due to the unique edge geometry of the fin, the user notices less effort in obtaining thrust in comparison to the known fin configurations. This is in part due to favorable vortices created as the fin undergoes its vertical sweeps through the water and also due to the particular displacement path of the water as the fin sweeps through. The side rails may undergo fine adjustments during manufacture to alter operating parameters such as its flexion, tension, pitch, geometry and/or a combination of each to alter slightly the water flow over the fin and ultimately aqua dynamics of the fin. The rails are preferably U or V shaped and reduce drag on the downward thrust but with lateral stability.

Figure 6:
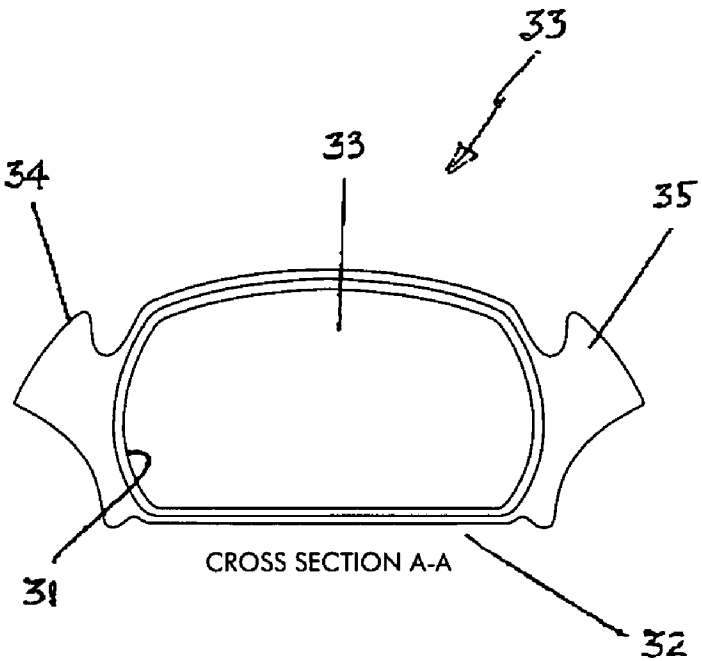
FIG. 6 shows a cross section across a line A—A as shown in FIG. 3 according to an alternative embodiment.

FIG. 6 shows a cross section taken along a line A—A through a fin according to an alternative embodiment and manufactured in accordance with a method aspect of the invention. Fin 30 comprises a first inner soft layer 31 of rubberized material which is heat fused with a second layer outer layer 32 of hard rubberized material forming molded foot pocket 33 which receives and retains a foot of a wearer. The result is a generally hard outer layer 32 and a soft inner layer 31 for foot comfort. Fin 30 further comprises lateral hard splay rails 34 and 35 which provide lateral stiffness and also contribute to improved aqua dynamics of the fin.

According to an alternative embodiment, layer 35 maybe substituted with either a medium hardness or soft layer. Thus inner layer 31 is in each embodiment a soft layer. Thus the fin according to two embodiments may be constructed from an inner soft layer and an outer medium hardness layer or from an inner soft layer and an outer hard layer. In the context of the invention, outer layers will be stiffer and harder than an inner foot pocket layer.

A soft layer is preferably within the range of 35–40 gerometers. A medium layer is between 41–60 gerometers and a hard layer is within the range of 61–75 gerometers.

Figure 7:
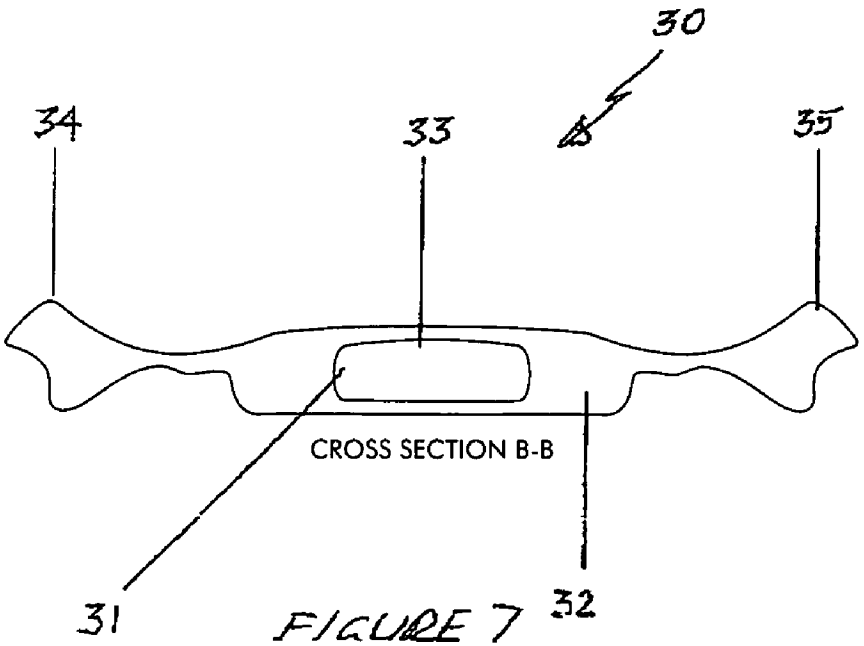
FIG. 7 shows a cross section across a line B—B as shown in FIG. 3 according to one embodiment.

FIG. 7 shows a cross section of fin 10 shown in FIG. 3 taken across line B—B with numbering corresponding to parts in FIG. 6. Line B—B is closer to the wide tapered end 15 of fin 30 .

Figure 8:
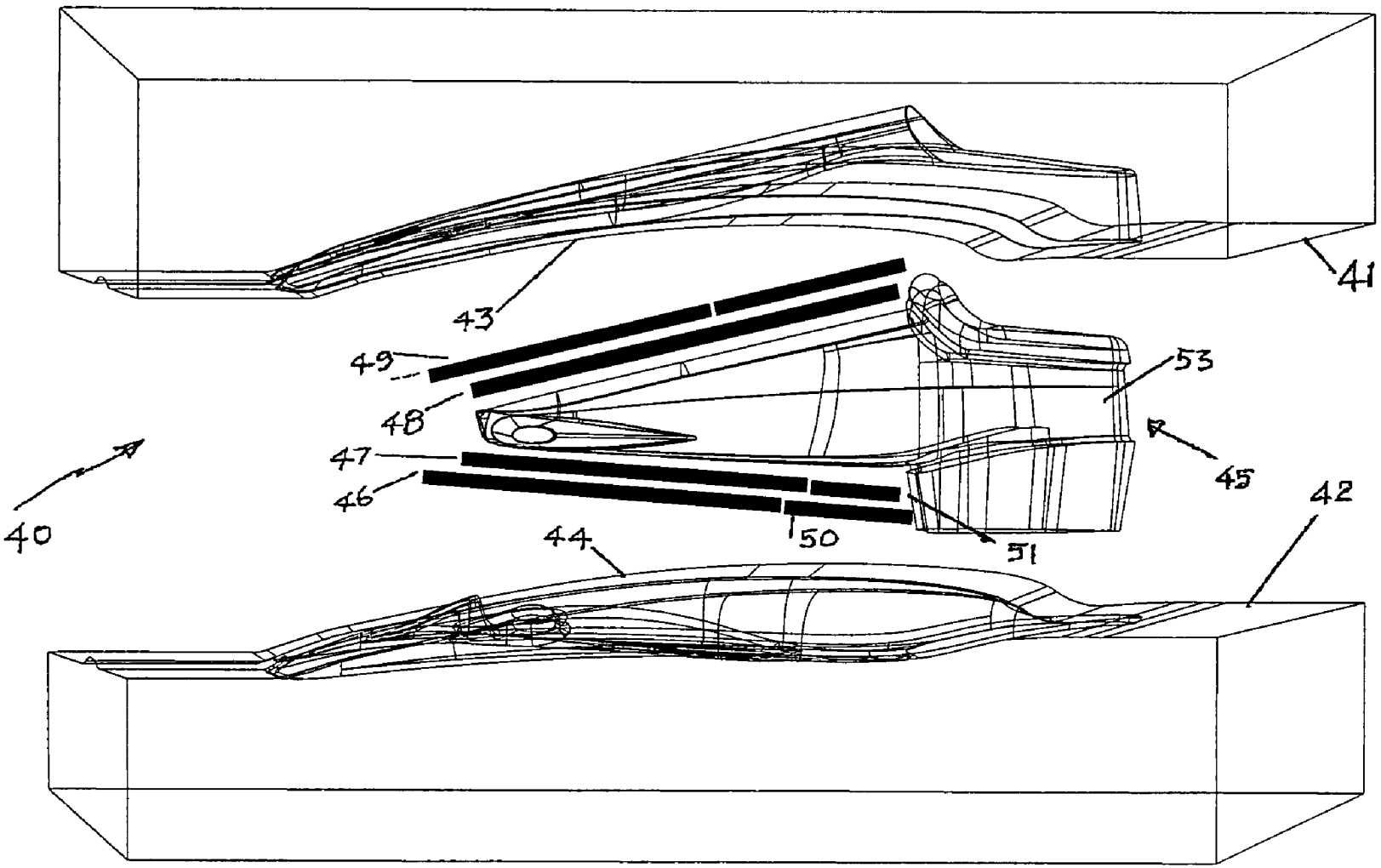
FIG. 8 shows a schematic arrangement of an assembly for constructing a fin in accordance with the present invention.

FIG. 8 shows an exploded view of an assembly 40 for manufacture of a fin in accordance with an embodiment of a method aspect. Assembly 40 comprises upper mold part 41 and lower mold part 42. Mold part 41 includes a molded recess 43 which has a molded profile of an upper surface of a fin to be made form the mold. Mold part 42 includes a molded outstanding profile 44 which has a molded profile of an upper surface of a fin to be made form the mold. Intermediate mold parts 41 and 42 is a foot mold 45 which allows formation of a foot pocket (such as foot pocket 12 shown in FIG. 3). When a fin is to be formed, layers forming an underside of a fin are disposed underneath foot mold 45. In FIG. 8 there are shown two layers 46 and 47 which will form the underside of a fin. Layer 46 is preferably a hard stiff layer and layer 47 is a soft layer as it will form a tread in a foot pocket of the fin. Abutting layer 46 is a layer 50 of a hard material overlain by a layer of soft material 51. Soft layer 51 will during compression molding of the fin when mold parts 41 and 42 are joined in opposing relationship migrate through channel 53 to form a heel strap of the fin. Layer 48 is a soft layer which forms an inside upper layer of a foot pocket. Layer 49 is a hard compound layer and forms an outer upper surface of the fin.

Once each of the aforesaid layers are set in position compression molding takes place which fuses layers in contact with each other until the fused rubber conforms to the shape of the profiles 43 and 44 and in conjunction with foot mold 45 forms a fin having prescribed parameters.

A fin manufactured in accordance with the method of the invention described herein has advantages of stiffness and flexibility with retention of elasticity, reduced weight increased user comfort and softness and potentially improved manufacturing cycle time. The costs of materials may be reduced due to the use of less hard material which is typically more expensive. According to one embodiment of the method aspect, the bonding of layers may be by a combination of heat fusion and compression.

The method of construction may comprise the further preliminary step of milling the rubber layers to a predetermined thickness. A preferred (but non limiting) layer thickness would be in the region of 10–15 mm. The layers can be milled to as low as 3 mm thick by running the layers through a rolling machine. Also, each layer may be of varying thicknesses.

It will be recognized by person skilled in the art that numerous variations and modifications may be made to the invention without departing from the overall spirit and scope of the invention broadly described herein.

The invention claimed is:

1. A swim fin formed from laminated rubberized layers; the fin comprising;

a) a fin body including a foot pocket, which includes an opening to receive the foot of a wearer;

b) fin body including a distal trailing region integral with said foot pocket capable of flexure upwardly, downwardly and rearwardly of the body, by action of water when the fin is in use;

c) means for engaging a heel of a user to maintain a users foot in said foot pocket;

d) the fin including at least one outer rubberized layer and at least one inner rubberized layer, the at least one inner layer forming said foot pocket, said at least one inner layer forming the foot pocket is a soft compound rubber and has a first color indicating the soft compound rubber, and said at least one outer layer is a harder compound rubber than the soft compound rubber of said at least one inner layer and has a second, different color indicating the harder compound rubber; wherein the fin is produced in a compression mold having first and second mold parts and a foot mold for forming said pocket.

2. A fin according to claim 1 wherein a lower region of the foot pocket comprise two layers a first of which is a soft inner layer and the second of which is an outer hard layer.

3. A fin according to claim 2 wherein an upper region of said foot pocket comprises two layers a first of which is a soft inner layer and the second of which is an outer hard layer, each of the layers having a different color.

4. A fin according to claim 3 wherein the wide distal region comprises two hard layers.

5. A fin according to any one of claims 1 or 2 through 4 further comprising lateral splay rails which contribute to the aqua dynamics of the fin.

6. A fin according to any one of claims 1 through 4 further comprising a layer of medium hardness.

7. A fin according to claim 6 wherein the medium layer is formed by fusion of said hard and soft layers.

8. A fin according to claim 7 wherein a soft layer is within the range of 35–40 gerometers.

9. A fin according to claim 8 wherein a medium layer is between 41–60 geometers.

10. A fin according to claim 9 wherein a hard layer is within the range of 61–75 gerometers.

11. A fin according to any one of claims 1 through 4 wherein the thickness of each layer is approximately 5 mm.

12. A swim fin made from laminated layers of rubberized material, the fin comprising:

a foot pocket for receiving a foot of a wearer;

a retaining element for retaining a foot of a wearer in said foot pocket during use of the fin;

a wide distal region for allowing propulsion of a user through water;

the foot pocket comprising;

at least one layer of rubber each having a first degree of hardness; the retaining element comprising at least one layer of rubberized material having said first degree of hardness;

the wide distal region comprising at least two rubberized layers having a second degree of hardness and being a harder material than the layers having said first degree of hardness, the layer having said first degree of hardness having a first color indicating the first degree of hardness, and the layer having said second degree of hardness having a second, different color indicating the second degree of hardness; wherein the fin is made in a compression mold.

13. A fin according to claim 12 wherein two soft rubberized layers form the retaining element.

14. A swim fin for use on the foot of a swimmer, the fin comprising;

a foot body defining a foot receptacle, that includes an opening to receive a foot of a wearer;

first fin body integral with and extending from the body of the foot receptacle and which is capable of being flexed upwardly and downwardly during use and responsive to water pressure wherein, the foot body comprises a soft compound rubber and the fin body includes a medium compound rubber;

the fin body further comprising lateral hard rubber regions between the medium and soft compounds wherein the hard rubber regions and medium rubber layer combine to form contoured splay rails which contribute to water displacement and propulsion of the user, and the soft compound rubber of the foot body and the medium compound rubber of the fin body have different colors to indicate hardness.

15. A fin according to claim 14 wherein the splay rails are laterally disposed and symmetrical about a longitudinal axis through the fin.

16. A laminated swim fin formed using three rubberized layers each having different hardness; the fin comprising;

a foot body defining a foot pocket that includes an opening to receive the foot of a wearer;

a distal region integral with and extending from the foot pocket to be flexed upwardly and downwardly and rearwardly of the body, by action of water when the fin is in use;

the fin including an outer layer of medium hardness rubberized material;

an inner layer of soft compound rubber forming the foot receptacle;

a layer of hard rubberized material; wherein, the layer of hard material is disposed laterally of the foot receptacle, and the soft compound rubber has a first color and the medium hardness rubber material has a second, different color to indicate hardness.

17. A fin according to claim 16 wherein the hard layer has a third color.

18. A fin according to claim 17 wherein the colors of said layers provide an indication of the hardness or stiffness of the layers which comprise the fins.

19. A method of construction of a swim fin using a compression mold, the method comprising the steps of;

a) providing at least one layer of rubberized material having a first degree of hardness;

b) providing at least one layer of rubberized material having a second degree of hardness and being a harder material that the first degree of hardness layer;

c) taking a mold capable of forming a foot cavity in said fin and placing the mold over at least the said at least one layer of rubberized material having a first degree of hardness;

d) laying over the foot mold two rubberized layers of either the same or different hardness, the layers having different color from the rubberized material having a first degree of hardness to indicate different hardness, e) compression molding all said layers about said foot mold such that at least layers adjacent said mold conform to the shape of said mold and form a foot pocket;

f) separating mold parts of said compression mold;

g) removing said foot mold from a foot pocket in a so formed fin.

20. A method according to claim 19 wherein the at least one layer having a first degree of hardness is disposed in a in a region of the fin approximating the position of a users ankle.

21. A method according to claim 20 wherein the at least one layer having a second degree of hardness is in a region of the fin proximate a users toes.

22. A method according to claim 21 wherein the at least one layer having a second degree of hardness is in a region of the fin distal to a users user's toes.

23. A method according to claim 22 wherein there are two layers of rubberized material having the first degree of hardness approximating a position in the fin of the users ankle.

24. A method according to claim 23 wherein there are two layers having said second degree of hardness.

25. A method according to claim 24 wherein, the two rubberized layers placed over the foot mold comprise one layer of the first degree of hardness and one layer of the second degree of hardness.

26. A method according to claim 25 wherein the layers fuse and migrate during said compression molding.

27. A method according to any one of claims 1 through 4 wherein there is adjacent said at least one layers having the first and second degree of hardness an additional layer of rubberized material having a third degree of hardness.

28. A method according to claim 27 wherein, the layers are the same or different colors.

29. A method according to claim 28 wherein contrasting colors enable tracking of migration of layers during compression molding.

30. A method of manufacture of a swim fin from a compression mold;

the method comprising the steps of;

a) taking a compression mold having first and second corresponding mold parts;

c) placing at least one layer of rubberized material having a first degree of hardness over a first said mold parts;

d) taking a foot mold capable of forming a foot cavity in said fin and placing the foot mold over at least the at least one layer of rubberized material;

e) providing over the foot mold two rubberized layers of either the same or different hardness, the layers having different color from the rubberized material having a first degree of hardness to indicate different hardness, e) compression molding all said layers such that at least layers adjacent said mold conform to the shape of said mold parts and form a foot pocket f) removing said foot mold from the so formed fin.

31. A laminated swim fin formed in a compression mold, the fin including a leading end and a trailing end, the leading end including a recess for receiving a foot of a wearer and the trailing end being a free end which displaces water each sweeps through the water;

the fin including a laminated construction comprising a first layer of medium hardness rubberized material;

a second layer of hard rubberized material and a third layer of soft rubberized material;

wherein the first and second layers envelope said third layer of soft material and the soft layer forms a foot pocket in said fin, and the layers having different colors to indicate different hardness.

32. A fin according to claim 31 wherein said layers are laminated by a combination of heat fusion and compression.

33. A fin according to claim 32, having a stiff intermediate hard layer, a medium outer layer of reduced stiffness and a foot pocket of an inner layer of soft rubber.

34. A fin according to any one of claims 1 or 2 through 4 where the thickness of the layers is within the range 3–15 mm.

35. A fin according to any one of claims 1 or 2 through 4 wherein the layers are of varying thickness.

* * * * *